US006258504B1

(12) United States Patent
Bartus et al.

(10) Patent No.: US 6,258,504 B1
(45) Date of Patent: Jul. 10, 2001

(54) TONER CONTAINING RESIN PREPARED BY A COMBINATION OF EMULSION FOLLOWED BY SUSPENSION POLYMERIZATION

(75) Inventors: Jan Bartus; Robert Janules, both of Merrimack; James Boswell, Nashua; Jeffrey Clark, Milford, all of NH (US)

(73) Assignee: Nashua Corporation, Nashua, NH (US)

( * ) Notice: Subject to any disclaimer, the term of this patent is extended or adjusted under 35 U.S.C. 154(b) by 0 days.

(21) Appl. No.: 09/417,430

(22) Filed: Oct. 13, 1999

(51) Int. Cl.[7] ..... G03G 5/00
(52) U.S. Cl. ..... 430/137
(58) Field of Search ..... 430/137

(56) References Cited

U.S. PATENT DOCUMENTS

| | | | |
|---|---|---|---|
| 4,968,574 | 11/1990 | Morita et al. | 430/109 |
| 5,071,918 | 12/1991 | Funato et al. | 525/273 |
| 5,204,413 | 4/1993 | Funato et al. | 525/273 |
| 5,310,812 | 5/1994 | Yasuda et al. | 525/309 |
| 5,683,847 | 11/1997 | Patel et al. | 430/137 |
| 5,716,746 | 2/1998 | Mikuriya et al. | 430/106.6 |
| 5,736,288 | 4/1998 | Kasuya et al. | 430/106.6 |
| 5,738,964 | 4/1998 | Uchida et al. | 430/109 |
| 5,744,276 | 4/1998 | Ohno et al. | 430/109 |
| 5,750,301 | 5/1998 | Funato et al. | 430/106.6 |
| 5,852,147 | 12/1998 | Yoo et al. | 526/224 |
| 5,928,830 | 7/1999 | Cheng et al. | 430/137 |

OTHER PUBLICATIONS

Schlund et al., *Polymer*, vol. 60, pp. 1883–1894 (Oct. 1989).
Hergeth et al., *Polymer*, vol. 60, pp. 1913–1917 (Oct. 1989).

*Primary Examiner*—Mark Chapman
(74) *Attorney, Agent, or Firm*—George W. Neuner; Lisa Swiszcz Hazzard; Dike, Bronstein, Roberts & Cushman, IP Group

(57) ABSTRACT

A method for preparing thermoplastic toner resins is disclosed and the toner resins produced by said method. More particularly, an emulsion polymerized resin, constituting a high molecular weight component, is used as a seed for subsequent suspension polymerization of a lower molecular weight component. The emulsion micelles are swelled with monomers and subsequent suspension polymerization produces particles where the high and low molecular weight components are interpenetrated to form a resin with a bimodal distribution of molecular weight. A toner composition is made using the resin as the main component. The resin particle has a first resin portion having a particle size in the range of about 50 to about 200 nm. and a number average molecular weight in the range of about $10^4$ to about $10^7$, and a second resin portion formed around the first resin portion with a number average molecular weight lower than that of said first resin portion, the resin having a polydispersity in the range of 5 to 50.

30 Claims, 5 Drawing Sheets

TONER CONTAINING RESIN PREPARED BY A COMBINATION OF EMULSION FOLLOWED BY SUSPENSION POLYMERIZATION

BACKGROUND OF THE INVENTION

1) Field of the Invention

The present invention relates to toners containing resin particles having an inner portion of resin material with a relatively high molecular weight and an outer portion of resin material having a relatively lower molecular weight, and to methods for producing the toner resins by using emulsion polymerization followed by suspension polymerization techniques. More specifically, this invention relates to the use of an emulsion copolymer as a seed for the formation of particles in suspension polymerization.

2) Description of the Related Art

Styrene-acrylate and styrene-methacrylate copolymers have been used as toner resins for many years, and there are different methods known for preparing such resins.

Suspension polymerization is considered one of the easiest methods for preparing toner resins. Styrene-acrylate, styrene-methacrylate and styrenebutadiene copolymers prepared by suspension polymerization are some of the most common examples of toner resins. Emulsion copolymerization is another method for preparing toner resins (e.g. U.S. Pat. No. 5,683,847), but this method is applied less frequently than suspension polymerization is applied.

Many toner formulations utilize mechanical mixtures of polymers with different polarities and molecular weight. It is known that high molecular weight polymers (HMWP) have good mechanical properties but they are difficult to process. Low molecular weight polymers (LMWP) typically have excellent processability, but the products from them possess diminished mechanical properties. The mechanical blend of a HMWP with a LMWP was an obvious option to attempt to combine the major advantages of both materials. Unfortunately, such a blend is usually characterized by flow instability in the molten state. This is due to the difficulty in mixing together, on a molecular level, polymers with considerably different molecular weights. To improve the interpenetration of polymer chains, a longer processing time in a molten state would be required. However, extended exposure to high temperatures and oxygen leads to undesirable degradation. Thus, methods whereby a polymer blend with good processability and excellent mechanical properties may be obtained are still being sought. It has been taught that the individual high and low molecular weight components, forming a bimodal distribution of molecular weight (DMW), should meet certain requirements to produce adequate electrostatic images. For example, it is claimed in U.S. Pat. No. 5,716,746 that if the low molecular weight (LMW) component has a molecular weight less than 5,000, the anti-blocking properties of the toner may be lowered and fogging during the development process may occur. On the other hand, if the LMW component has a molecular weight above 20,000, then the low temperature fixing performance may become poor. Similar restrictions apply also to the high molecular weight (HMW) component. If the HMW component has a molecular weight below 200,000, anti-blocking and anti-offset properties are lowered. If the HMW component has a molecular weight above 1,000,000, toner viscosity increases thereby making the low-temperature fixing performance poor. Magnetic toner resins with a bimodal distribution are, thus, produced according to U.S. Pat. No. 5,716,746 by first synthesizing a LMW component and subsequently synthesizing a HMW component within these limits.

Toner resins with bimodal and trimodal distribution of molecular weight are prepared according to U.S. Pat. No. 5,738,964 by blending of individual components in xylene solution and evaporation of solvent. Bimodal resins also have been obtained by two subsequent solution polymerizations (U.S. Pat. No. 5,750,301).

U.S. Pat. Nos. 5,736,288 and 5,744,276 describe the preparation of a toner resin with a bimodal DMW. The low molecular component is prepared by a solution copolymerization in xylene. The high molecular portion is prepared by a separate suspension polymerization or in bulk. Both components are combined in xylene and isolated after evaporation of solvent. A modification of above procedure is given in the U.S. Pat. No. 5,310,812, in which the low molecular component is first prepared in solution, isolated from the solvent and dissolved in monomers used for suspension polymerization of the high molecular component.

A toner resin with bimodal DMW is prepared according to U.S. Pat. No. 4,968,574 by two subsequent suspension polymerizations. In the first suspension polymerization, benzoyl peroxide (BPO) initiator is used in the amount of 0.2% on monomers producing a HMW component. A LMW component is then produced by swelling the beads with a subsequent portion of monomers with 4% of BPO. A similar two-step suspension polymerization process is described in U.S. Pat. Nos. 5,071,918 and 5,204,413. The HMW component is prepared in those instances by using a multifunctional initiator and the LMW component is prepared by use of a higher amount of BPO.

More recently, in U.S. Pat. No. 5,852,147 a styrene-acrylic copolymer with a bimodal DMW was prepared by a combination of two subsequent emulsion copolymerizations. In the first step, a HMW latex is prepared using a very small amount of chain transfer agent. The prepared emulsion is transferred into a second reactor after the addition of a fresh portion of monomers, an initiator and a high amount of mercaptan chain transfer agent (5% on monomers). The second step emulsion copolymerization is then carried out. The resulting latex has a bimodal DMW, as shown by a GPC measurement.

Schlund et al. (*Polymer*, 1989, Vol. 60, October, pp. 1883–94) reported on films made from polymer particles having core-shell, multilayer of homogeneous structures. Thermomechanical analysis of the corresponding films suggests that two or more phases exist in the core-shell or multilayered latex particles. Hergeth et al. (*Polymer*, 1989, Vol. 60, October, pp. 1913–17) reported conditions for forming shells on polymeric seeds for a two-stage emulsion polymerization technique.

More recently, U.S. Pat. No. 5,928,830 described latex processes for preparation of a polymer resin wherein emulsion polymerization techniques are used to prepare a low molecular weight core. A shell of substantially higher molecular weight second polymer is then formed by emulsion polymerization over the core particles.

New, useful and economical methods for making toner resins having a suitable combination of HWM and LMW components to form resins with bimodal distribution of molecular weight having good processability and excellent mechanical properties are still being sought.

SUMMARY OF THE INVENTION

The present invention provides a method for the preparation of toner resins based on a combination of emulsion polymerization followed by suspension polymerization techniques. The process allows the preparation of resin having a bimodal distribution of molecular weight. A high molecular weight component is prepared first by emulsion polymerization. The solubility of the resin can be decreased by a small amount of a crosslinking agent. The micelles produced by emulsion copolymerization are swelled with monomers and subsequent suspension copolymerization produces particles where high and low molecular weight copolymers are interpenetrated to form a resin with a bimodal distribution of molecular weight. The low molecular weight component preferably is produced by the action of a small amount of chain transfer agent in the suspension polymerization phase. Preferably, the emulsion polymerization and the suspension polymerization steps use the same monomers for polymerization. The resins of the present invention are useful particularly in electrophotography as a main component for toner, especially where a broad distribution of molecular weight is desired. The toners, which typically also contain a pigment and preferably a charge control agent, are made by conventional techniques.

DETAILED DESCRIPTION OF THE INVENTION

Figure 1:
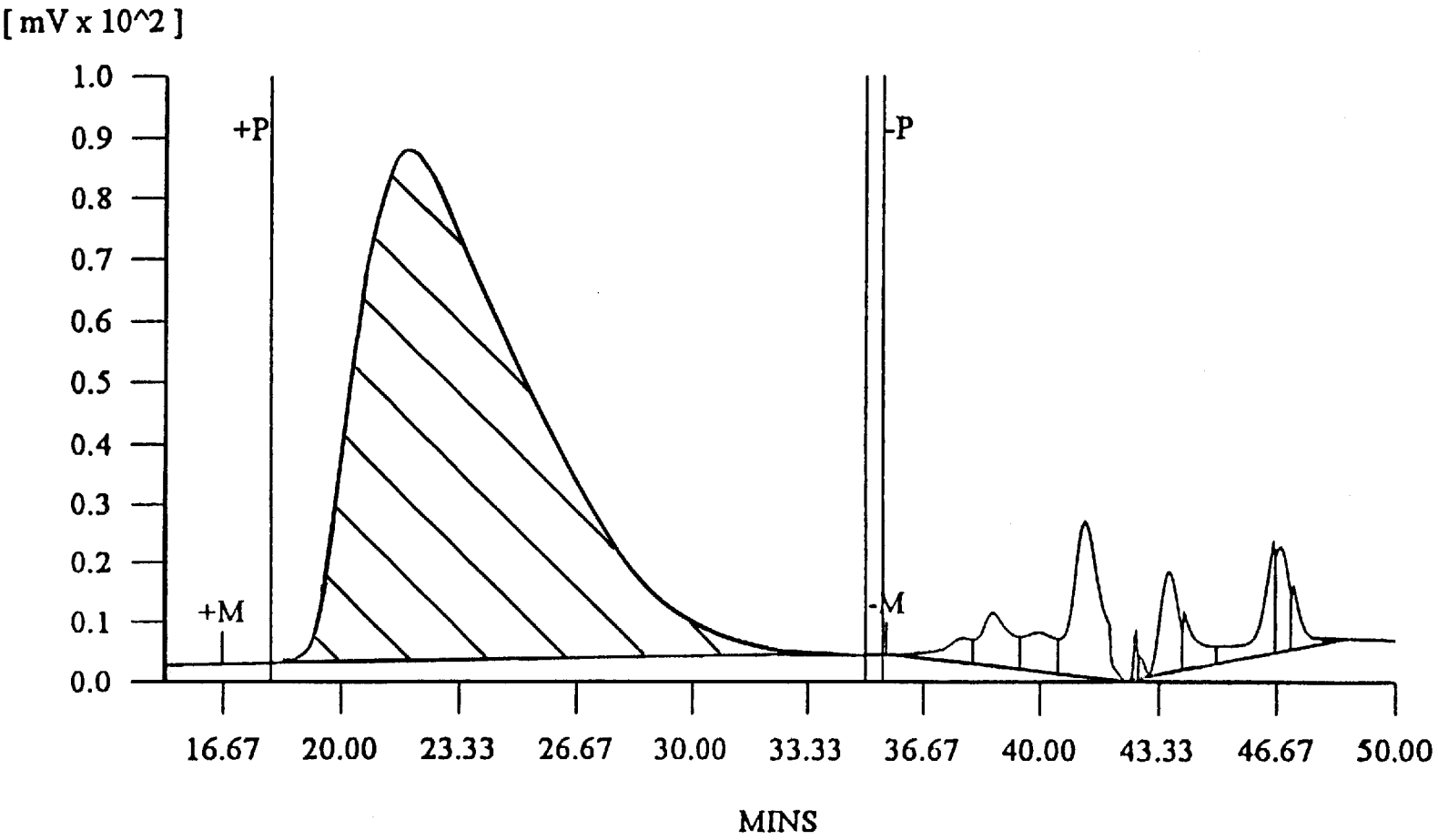
FIG. 1 is an illustration of distribution of molecular weight obtained by a size exclusion chromatography using the UV detector of prepared HMW resin in Example 1.

In accord with the present invention, a preferred method of preparing a toner resin uses emulsion polymerization followed by suspension polymerization techniques whereby the resulting toner resin particles possesses a bimodal distribution of molecular weight. By preparing very small HMW emulsion particles (about 50–200 nanometers) that are swelled and partially dissolved in added monomers, subsequent heating to reaction temperature allows the monomers to diffuse deeper into the emulsion polymer so that a resin, having a microinterpenetrated network of HMW and LMW components, is formed in the subsequent suspension polymerization. The emulsion and suspension polymerizations can be performed in two separate reactors or the synthesis can be conducted as a one-pot reaction process.

Preferably, styrene, acrylate and methacrylate monomers are used for synthesizing the high and low molecular weight components. Emulsion copolymerization of styrene-acrylate or styrene-methacrylate monomers provides copolymers as fine emulsion latex with particle size usually in the range 20–500 nm. The molecular weight of the copolymers is very high (typically about 104–107 number average molecular weight) and it can be decreased by the use of chain transfer agents (e.g. thiols, disulfides or halogen-containing compounds). If a higher molecular weight is required, a small amount of crosslinking agent (e.g. divinyl benzene, ethylene glycol dimethacrylate or trimethylolpropane triacrylate) can be added.

Examples of acceptable styrene monomers for first step, i.e., the emulsion copolymerization step include: styrene, α-methylstyrene, o-methylstyrene, m-methylstyrene, p-methylstyrene, p-methoxystyrene, p-ethylstyrene, 2,3-dimethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-phenylstyrene, p-chlorophenylstyrene, o-chlorostyrene, m-chlorostyrene, p-chlorostyrene, 3,4-dichlorostyrene.

Some examples of acrylate monomers that can also be used for the emulsion polymerization include: acrylic acid, methyl acrylate, ethyl acrylate, n-propyl acrylate, iso-propyl acrylate, n-butyl acrylate, iso-butyl acrylate, amyl acrylate, isoamyl acrylate, n-hexyl acrylate, n-octyl acrylate, 2-ethylhexyl acrylate, lauryl acrylate, n-tridecyl acrylate, n-tetradecyl acrylate, n-hexadecyl acrylate, 2-phenoxyethyl acrylate, 2-chloroethyl acrylate, 2,2,2-trifluoroethyl acrylate, 2-hydroxyethyl acrylate, 2-hydroxypropyl acrylate, dimethylaminoethyl acrylate, diethylaminoethyl acrylate, cyclohexyl acrylate, phenyl acrylate, isobomyl acrylate, stearyl acrylate, acrylonitrile, acrylamide.

Appropriate methacrylate monomers for the emulsion polymerization can include: methacrylic acid, methyl methacrylate, ethyl methacrylate, n-propyl methacrylate, iso-propyl methacrylate, n-butyl methacrylate, iso-butyl methacrylate, amyl methacrylate, isoamyl methacrylate, n-hexyl methacrylate, n-octyl methacrylate, 2-ethylhexyl methacrylate, lauryl methacrylate, n-tridecyl methacrylate, n-tetradecyl methacrylate, n-hexadecyl methacrylate, 2-phenoxyethyl methacrylate, 2-chloroethyl methacrylate, 2,2,2-trifluoroethyl methacrylate, 2-hydroxyethyl methacrylate, 2-hydroxypropyl methacrylate, dimethylaminoethyl methacrylate, diethylaminoethyl methacrylate, cyclohexyl methacrylate, phenyl methacrylate, isobomyl methacrylate, stearyl methacrylate, methacrylonitrile, methacrylamide.

The emulsion copolymerization is an exothermic reaction, especially when a large amount of acrylic or methacrylic monomer is used. Thus, water is added to act as a dispersion medium, absorbing the released heat of reaction and transferring it to the reactor walls.

Water soluble initiators are typically required for the emulsion copolymerization. Some examples of initiators include: persulfate salts (e.g. potassium persulfate, sodium persulfate, ammonium persulfate), hydrogen peroxide or organic hydroperoxides (such as t-butyl hydroperoxide, cumene hydroperoxide) in combination with metal salts (copper sulfate, iron sulfate, manganese chloride, cobalt sulfate) forming a redox system. Preferably, the initiators are used in concentrations $1\times10^{-2}$ to $1\times10^{-4}$ mol/L in water solution.

During emulsion copolymerization, the use of stabilizers in the form of emulsifiers is advantageous. These emulsifiers typically are surfactants with limited solubility in water, which are capable of forming hydrated aggregates, called micelles. Emulsifiers directly impact latex particle size, polymerization rate and the molecular weight of the polymer. The key to their effectiveness is their unique structure. They contain a hydrophilic functional group that is bound to an extended hydrophobic group. In an oil in water emulsion, the surfactant is oriented at the interphase between oil and water in such a way that the hydrophilic group is immersed in the water phase and the hydrophobic group in the oil phase. This orientation increases the emulsion stability because it helps to lower the interfacial tension. There are three main groups of emulsifiers useful in the present invention: anionic, cationic and nonionic emulsifiers. Anionic emulsifiers include: carboxylate salts (sodium laurate, sodium stearate, sodium palmitate), alkyl sulfates (sodium lauryl sulfate, hydroxyalkane sulfates), arylalkylsulfonates and their salts (sodium salt of dodecylbenzene sulfonic acid, sodium xylene sulfonate, alkyl naphthalene sulfonates). Cationic emulsifiers include: quaternary alkanolamides (derived from stearyl, oleyl, lauryl, myristyl alcohols), alkyldimethylbenzyl ammonium chlorides, alkylpyridinium salts and others. Nonionic emulsifiers include: ethoxylated fatty alcohols, propoxylated fatty alcohols, ethoxylated fatty acids, propoxylated fatty acids, ethoxylated fatty amines, polyglycerol esters, glycerol ethoxylates, glycerol propoxylates, ethoxylated alkylphenols, rosinamine ethoxylates, ethoxylated phosphate esters and others. The emulsifiers are preferably used in amounts 1–4% by weight based on amount of monomer.

Chain transfer agents can be used in emulsion polymerization to modify the molecular weight of the polymer. Chain transfer agents operate to cause the transfer of radicals from existing growing polymer chains to new chains. In this invention, effective chain transfer agents do not affect the rate of polymerization. Less efficient chain transfer agents can retard and even terminate the reaction at high concentrations. The most preferable chain transfer agents include: certain halogen compounds (carbon tetrabromide, carbon tetrachloride, chloroform, dibromomethane, dichloromethane), sulfur containing compounds (ethanethiol, butanethiol, t-butyl mercaptan, n-octyl mercaptan, dodecanethiol, 2-mercaptoethanol, benzenethiol, thiophenol, ethyl mercaptoacetate, tetramethylthiuram disulfide) or some organic compounds (limonene, triethylamine, phenol, cresol, naphthol). The disadvantage to using mercaptans and their derivatives is their undesirable odor. The disadvantage to using halogen-containing compounds is their discoloration effect on polymers. These problems can be avoided using a relatively new chain transfer agent: alpha-methylstyrene dimer, which does not have an odor and produces low molecular weight polymers that are colorless even at high temperatures (Goi Chemical Co. Bulletin, Japan). Preferably, chain transfer agents are used in emulsion polymerizations in amounts 0.1 to 2% by weight based on amount of monomer.

Crosslinking agents can be used during emulsion polymerization to increase the molecular weight of the polymer. Preferably, crosslinkers having at least two double bonds are used. Some examples of suitable crosslinkers include: aromatic divinyl compounds (divinylbenzene, divinylnaphthalene), diacrylate compounds (ethylene glycol diacrylate, 1,3-butylene glycol diacrylate, 1,4-butanediol diacrylate, 1,5-pentanediol diacrylate, 1,6-hexanediol diacrylate), dimethacrylate compounds (ethylene glycol dimethacrylate, 1,3-butylene glycol dimethacrylate, 1,4-butanediol dimethacrylate, 1,5-pentanediol dimethacrylate, 1,6-hexanediol dimethacrylate), oligo and polyethylene glycol diacrylates (diethylene glycol diacrylate, triethylene glycol diacrylate, tetraethylene glycol diacrylate, polyethylene glycol #400 diacrylate, polyethylene glycol #600 diacrylate, ethoxylated Bisphenol A diacrylate, propoxylated Bisphenol A diacrylate), oligo and polyethylene glycol dimethacrylates (diethylene glycol dimethacrylate, triethylene glycol dimethacrylate, tetraethylene glycol dimethacrylate, polyethylene glycol #400 dimethacrylate, polyethylene glycol #600 dimethacrylate, ethoxylated Bisphenol A dimethacrylate, propoxylated Bisphenol A dimethacrylate), allyl acrylate, allyl methacrylate, polyfunctional crosslinkers (trimethylolethane triacrylate, trimethylolpropane triacrylate, pentaerythritol triacrylate, pentaerythritol tetraacrylate, tetramethylolmethane tetraacrylate, trimethylolethane trimethacrylate, trimethylolpropane trimethacrylate, pentaerythritol trimethacrylate, pentaerythritol tetramethacrylate, tetramethylolmethane tetramethacrylate, trialylcyanurate, triallyltrimellitate). The crosslinkers are preferably used in amounts of 0.001 to 2 parts per 100 parts of monomer.

It is known that emulsion polymerization is sensitive to pH of the reaction medium. The decomposition rate of initiators is also influenced by the pH. In order to regulate the pH of the reaction system, buffering compounds such as sodium hydrogen phosphate, sodium dihydrogen phosphate, sodium bicarbonate, sodium acetate, sodium citrate, or their potassium salts are used. However, buffers that can influence the colloidal stability of the emulsion are to be avoided.

Following emulsion polymerization of the high molecular weight component, the low molecular weight component is formed around the high molecular weight resin micelles by suspension copolymerization. Suspension techniques are well-known, and generally comprise: adding a mixture of monomers, initiators, and other additives to form an organic phase; followed by adding the organic phase to an aqueous phase consisting of water and a stabilizer; shearing the combined organic and aqueous phase; and finally, the monomers are polymerized by heating.

In general, the monomers used for the suspension polymerization are styrene, acrylate and methacrylate monomers. More specifically, the examples of suitable styrene, acrylate and methacrylate monomers listed above for the emulsion process are equally applicable for the suspension process.

Suitable initiators for the suspension process are those that are soluble in monomer phase. Accordingly, some initiators that can be used for the practice of this invention include: organic peroxides [benzoyl peroxide, lauroyl peroxide, acetyl peroxide, octanoyl peroxide, decanoyl peroxide, 3,3,5-trimethyl hexanoyl peroxide, dicumyl peroxide, t-butyl-cumyl peroxide, di-t-butyl peroxide, 1,1-bis(t-butylperoxy)3,3,5-trimethylcyclohexane, t-butylperoxy acetate, t-butylperoxy pivalate, t-butylperoxy-2-ethylhexanoate, t-butylperoxy laurate, t-butylperoxy benzoate] and azo-compounds [2,2'-azobis-isobutyronitrile, 2,2'-azobis-(2-methylbutyronitrile), 2,2'-azobis-(4-methoxy-2,4-dimethylvaleronitrile)].

Among the other additives that can be used during suspension polymerization are dispersing agents. Some examples of acceptable dispersing agents include: polyacrylic acid, sodium or potassium salt of polyacrylic acid, polyvinyl alcohol, partially saponified polyvinyl alcohol, cellulose derivatives, (hydroxypropylcellulose, carboxymethylcellulose), gelatin, inorganic powders (calcium phoshate, calcium sulfate, calcium carbonate, magnesium sulfate, barium sulfate, barium carbonate). These dispersing agents are preferably used in concentrations of 0.1 to 2% by weight in water phase.

To lower the molecular weight of the suspension component, additives in the form of chain transfer agents can be used. The examples of chain transfer agents listed above for emulsion polymerization are also suitable for suspension polymerization. Most preferably, alpha-methylstyrene dimer is used. The amount of chain transfer agents applied during suspension polymerization, however, is usually higher than the amount applied during emulsion polymerization, especially when a polymer with very low molecular weight (i.e., below about 5,000) is required.

Preferably, chain transfer agents for suspension polymerization are used in amounts of 2 to 6% by weight based on amount of monomer.

The time and temperature for the polymerization reaction can vary. Typically, the emulsion polymerization is conducted for 3 to 6 hours at 65–75° C., suspension polymerization for 4 to 6 hours at 85–95° C.

The ratio of emulsion to suspension copolymer varies, and is typically in the range of 10/90 to 90/10. As the emulsion component increases, the Shimadzu flow temperature likewise increases. An increase in the LMW suspension component has a reverse effect. The preferred percentage of emulsion component is 20–60% by weight of the total amount of resin.

The molecular weights of the emulsion polymer component and of the suspension polymer component can vary substantially depending on the conditions and components used for the reaction. The emulsion polymerization typically provides number average molecular weights in the range of $10^4$–$10^7$. The high molecular weight is a consequence of separation of the sites where primary radicals form from those where chain growth occurs. The lower values of molecular weights in emulsion polymerization step (in the range of about $10^4$–$10^5$) are achieved by using of chain transfer agents (thiols, halogenated compounds, some organic compounds) or with the help of high levels of initiator (0.5–4.0 wt % on monomers). The higher values of molecular weights in the emulsion polymerization step (in the range of about $10^6$–$10^7$) are obtained by the use of very low initiator levels (below 0.1 wt %) or when a small amount (0.1–2%) of multifunctional monomer is used. In embodiment, polymer samples of copolymer prepared by the emulsion copolymerization step showed a number average molecular weight in the range $8.0\times10^4$ to $6.5\times10^5$ (when analyzed by a GPC or SEC method, measured by a UV detector). Samples of resin where a small amount of ethylene glycol dimethacrylate had been used had infinite molecular weights and were insoluble in THF. In a preferred embodiment, the suspension copolymerization (without chain transfer agent) under ambient conditions provided polymer resins with number average molecular weights in the range $10^4$–$10^5$. In this system, when a chain transfer agent (alpha-methylstyrene dimer) was used in combination with higher content of benzoyl peroxide, in seven measured samples, the number average molecular weight (measured by a UV detector) was in the narrow range of $3.4\times10^3$ to $4.7\times10^3$. A preferred range of molecular weight for lower molecular weight resin made by suspension polymerization is in the range of about $2\times10^3$–$8\times10^4$ g/mol.

The resins and their components were characterized by four techniques. The distribution of molecular weight was determined by size exclusion chromotography (SEC) using Waters Model 510 SEC system with Waters 410 and 486 detectors. Polystyrene standards were used for calibration of the columns. The data was collected with a Perkin Elmer Turbochrom Workstation software and processed using a TurboSEC Version 6.1.0 software. The glass transition temperature (Tg) was obtained from Perkin Elmer DSC 7 system with a Pyris Software Version 3.5×. The melt flow properties of resins (temperatures $T_1$, and $T_2$) were tested on Shimadzu Flowtester CFT-500A. The latex particle size of prepared emulsions were measured on Horiba LA-910 laser scattering particle size distribution analyzer.

Polydispersity, the ratio of a weight average molecular weight to a number average molecular weight (Mw/Mn), is a measure indicating the width of the molecular weight distribution. In most conventional suspension polymerization reactions, the polydispersity of the resin produced is in the range of 1.5 to 3.5. In most conventional emulsion polymerizations, the polydispersity of the resin produced is in the range of about 1 to 3. The combination of emulsion and suspension polymerization in accord with the present invention allows one to substantially broaden the range of polydispersity. Depending on the amount of initiator used for the emulsion polymerization and the chain transfer agent applied in the suspension polymerization, the polydispersity can be in the range of 5 to 50.

Another measurement that expresses the difference between the high and low molecular weight component is to use the molecular weight at the maximum of the GPC recording for uncrosslinked samples. The difference between the suspension and emulsion portions can be substantial. The HMW emulsion polymerization portions may reach ranges as high as $1\times10^5$ to $8\times10^5$. The LMW suspension polymerization portions may reach maximum ranges of approximately $5\times10^3$ to $3\times10^4$.

The glass transition temperature (Tg) reflects the composition of the copolymer. In general, a copolymer of styrene with n-butyl acrylate with an 80/20 weight ratio has a Tg of approximately 65° C. In the bimodal distributions of resins made in accord with certain preferred embodiments of the present invention, a relatively lower content of n-butyl acrylate for the emulsion polymerization portion (about 15–20% by weight of the total monomers) typically resulted in a higher Tg of the core resin portion (in the range of about 65–75° C.) and a slightly higher content of n-butyl acrylate for the suspension polymerization portion (about 20–25% by weight of the total monomers) typically resulted in a lower Tg of the outer shell of the particles (in the range of about 54–65° C.).

The Shimadzu flow temperatures $T_1$, and $T_2$ reflect the molecular characteristics of the resin. In the case of a styrene n-butyl acrylate copolymer having a bimodal distribution of molecular weight, the low molecular weight component will melt earlier than the high molecular weight portion will melt. This improves processing characteristics of the resin. The flow temperature $T_1$, is characterized as a softening point of the resin and it is derived from the S-shaped flow curve. The range of observed values of $T_1$, for resins made in accord with preferred embodiments of the present invention was between about 100–140° C. The flow temperature $T_2$ is derived from the S-shaped flow curve as the temperature where the stroke of the plunger is 4 units higher that $T_1$. The range of observed values of $T_2$ for those embodiments was in the range of about 130–195° C.

The following non-limiting examples are further illustrative of the present invention.

EXAMPLE 1

Emulsion Copolymerization without Crosslinker

Into a 5 liter glass reactor equipped with a glass stirrer, condenser, nitrogen inlet and outlet were added 1,066 g of styrene (Chevron), 266 g of n-butyl acrylate (Union Carbide), 2,500 g of distilled water, 66 g of Rhodacal LDS-22 (Rhone-Poulenc, sodium dodecylbenzene sulfonate), 2 g of potassium persulfate (FMC Corporation) and 2 g of sodium dihydrogen sulfate (J. T. Baker). The content of the reactor was heated under nitrogen atmosphere to 70° C. and stirred for 6 hrs. After cooling to room temperature the emulsion was used for further suspension copolymerization. A small amount of emulsion (20 mL) was diluted with water and precipitated using an aluminum sulfate solution. The white copolymer was filtered on a glass frit, washed with water and dried. The product has Tg=72° C., Shimadzu flow temperatures $T_1$=138° C. and $T_2$=191° C. The SEC analysis (FIG. 1) provided Mw=808,780, Mn=215,620 and polydispersity (Mw/Mn)=3.7 using the UV detector.

EXAMPLE 2

Suspension Copolymerization with Emulsion Seed

Figure 2:
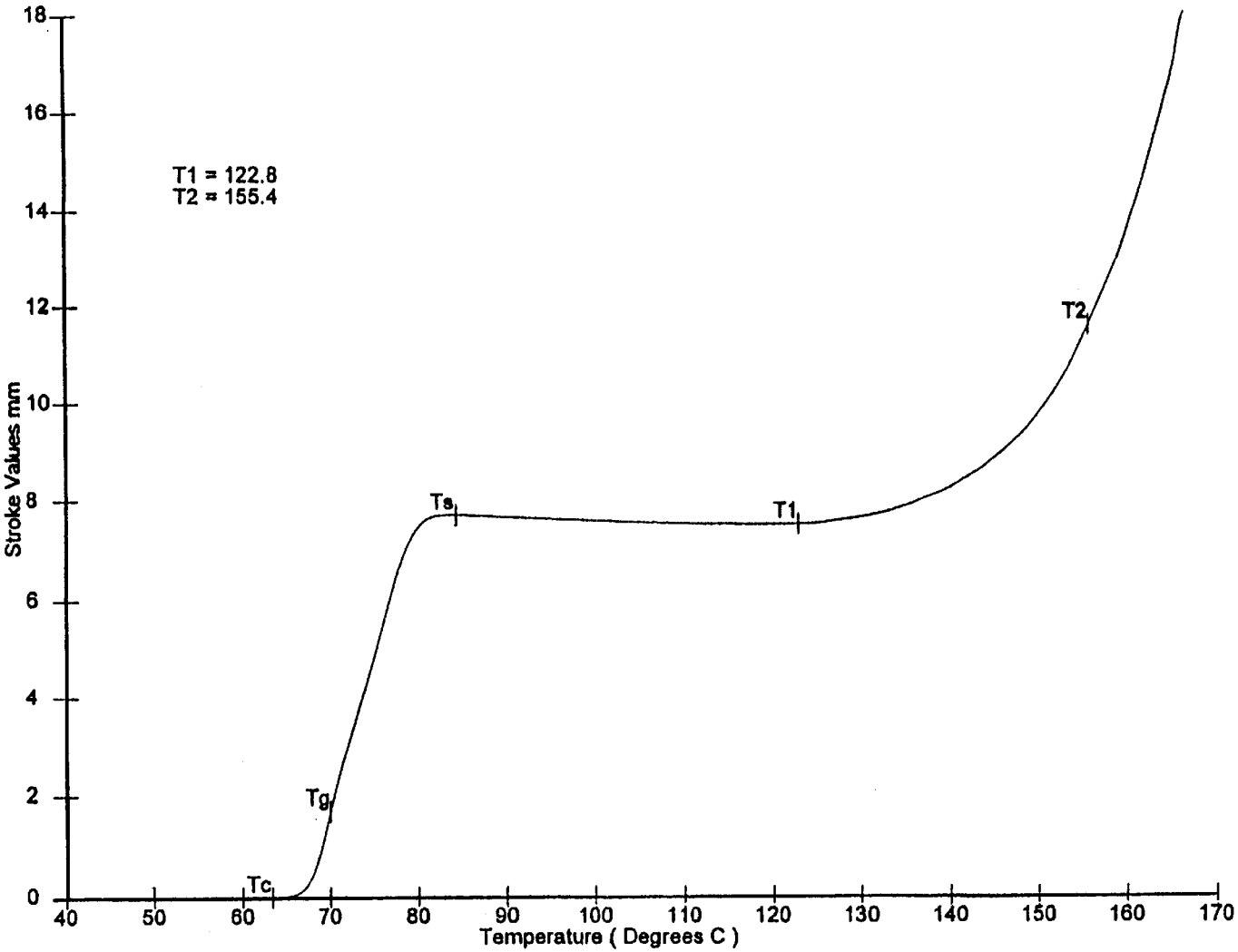
FIG. 2 documents a flow curve (using a Shimadzu Flowtester CFT-500A) of the bimodal resin obtained in Example 2.
Figure 3:
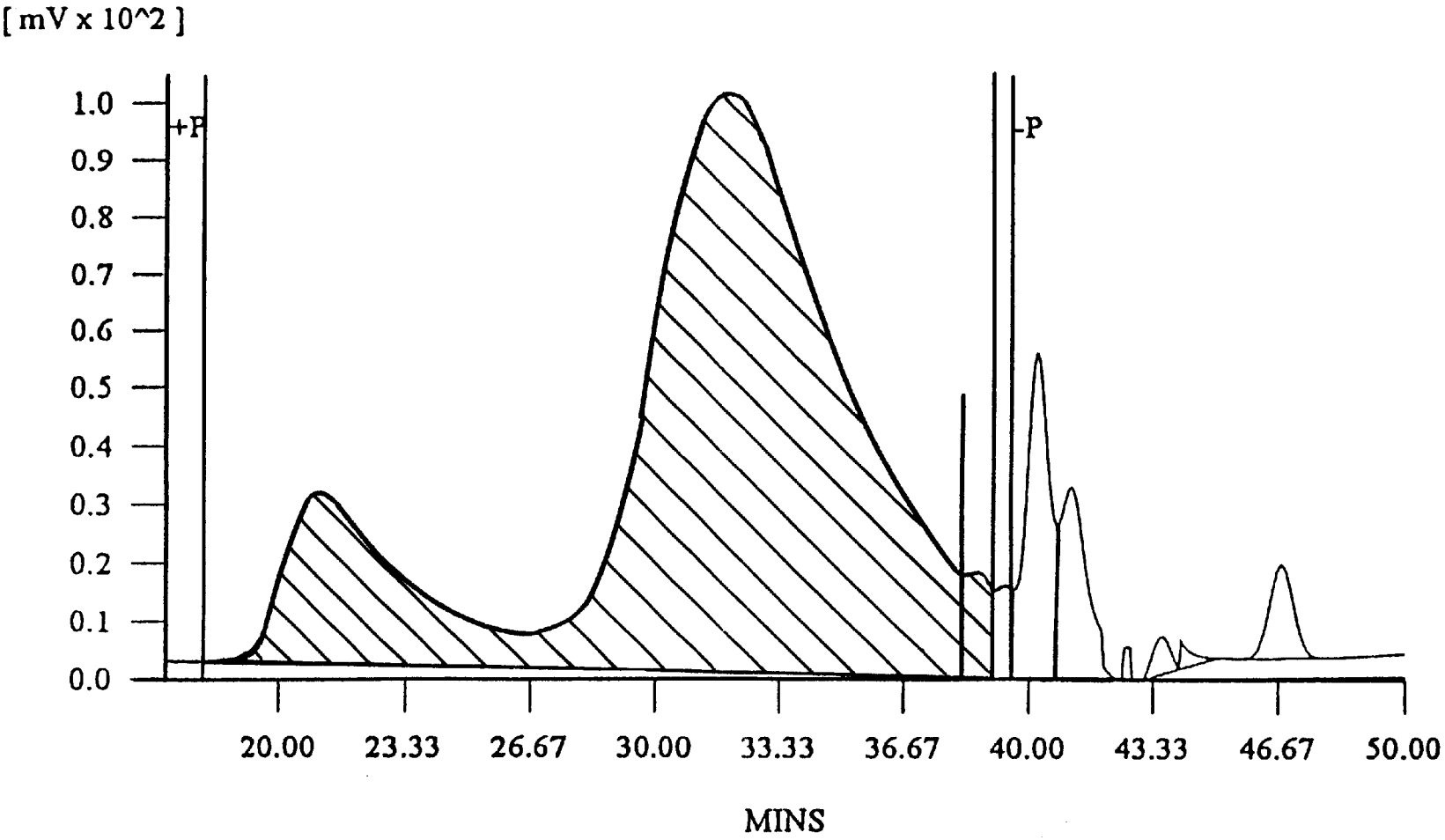
FIG. 3 shows a distribution of molecular weight obtained by a size exclusion chromatography using the UV detector of prepared bimodal resin in Example 2.

Into a 12 liter glass reactor equipped with a glass stirrer, condenser, nitrogen inlet and outlet were added 808 g of styrene, 212 g of n-butyl acrylate, 28 g of alpha-methylstyrene dimer (Goi Chemical Co.), 53 g of Luperox A75 (Elf Atochem, benzoyl peroxide), 6,642 g of distilled water and 130 g of 5% solution of Airvol 540 (Air Products and Chemicals, Inc., polyvinyl alcohol). The content of the reactor was heated under stirring to 30° C. and then 909 g of emulsion from Example 1 was added during 10 minutes. The heating continued and the reaction mixture was stirred for 6 hrs at 90° C. After cooling to room temperature the suspension was centrifuged, washed and dried in an oven at 60° C. The product has Tg=62° C., Shimadzu flow temperatures $T_1$=123° C. and $T_2$=155° C. (FIG. 2). The SEC analysis (FIG. 3) confined a bimodal distribution of molecular weight, Mw=175,700, Mn=4530, polydispersity (Mw/Mn)=38.8 using the UV detector.

EXAMPLE 3

Suspension Copolymerization without Emulsion Seed

Figure 4:
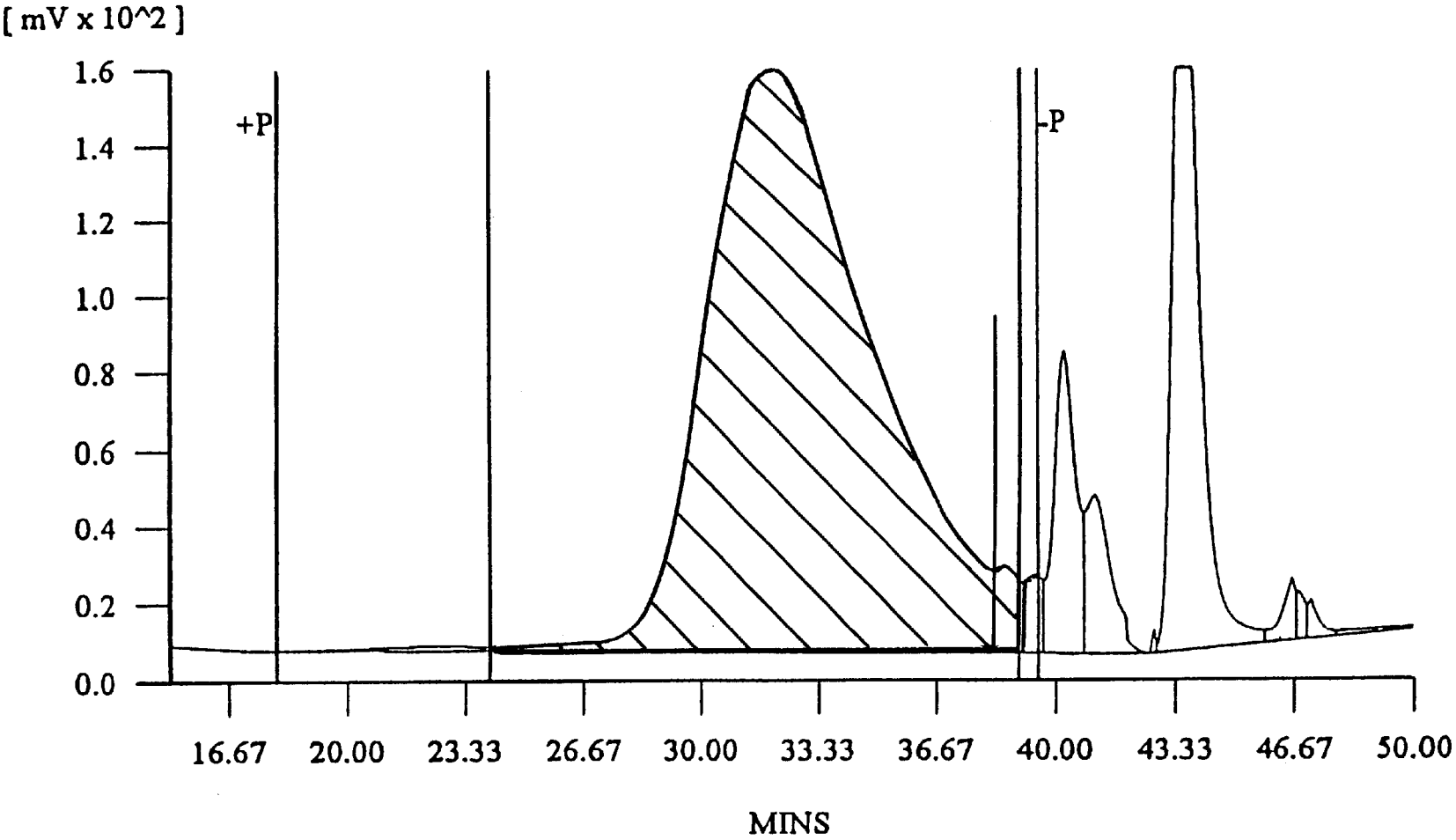
FIG. 4 shows a distribution of molecular weight obtained by a size exclusion chromotography using the UV detector of prepared LMW resin in Example 3.

Into a 1 L glass reactor equipped with a glass stirrer, condenser, nitrogen inlet and outlet were added 80.8 g of styrene, 21.2 g of n-butyl acrylate, 2.8 g of alpha-methylstyrene dimer, 5.3 g of Luperox A75, 664 g of distilled water and 13 g of 5% solution of Arivol 540. The content of the reactor was heated under stirring to 90° C. and the polymerization continued for 6 hrs. After cooling to room temperature the suspension was centrifuged, washed and dried in an oven at 60° C. The product has Tg=55° C., Shimadzu flow temperatures $T_1$=80° C. and $T_2$=103° C. The SEC analysis (FIG. 4) showed Mw=11,430, Mn=3450, polydispersity (Mw/Mn)=3.3 using the UV detector.

EXAMPLE 4

Emulsion Copolymerization with Crosslinker

Into a 50 gallon glass lined reactor equipped with an anchor-shaped stirrer, condenser, nitrogen inlet and outlet were added 37.1 lbs of styrene, 8.9 lbs of n-butyl acrylate, 86.3 lbs of deionized water, 2.4 lbs of Rhodacal LDS-22, 31.8 g of potassium persulfate and 96.1 g of ethylene glycol dimethacrylate (CPS Chemical Co., Inc.). The content of the reactor was heated under nitrogen atmosphere to 70° C. and stirred for 5.5 hrs. After cooling to room temperature the emulsion was used for further suspension copolymerization.

EXAMPLE 5

Suspension Copolymerization with Crosslinked Latex

Into a 50 gallon glass lined reactor equipped with an anchor-shaped stirrer, condenser, nitrogen inlet and outlet were added 10.3 lbs of styrene, 2.3 lbs of n-butyl acrylate, 0.5 lb of alpha-methylstyrene dimer, 1.4 lbs of Luperox A75, 93.0 lbs of deionized water and 2.1 lbs of 5% solution of Airvol 540. The content of the reactor was heated under stirring to 30° C. and then 25 lbs of emulsion from Example 4 was added during 20 minutes. The heating continued and the reaction mixture was stirred for 6 hrs at 90° C. After cooling to room temperature the suspension was centrifuged, washed and dried in an oven at 60° C. The product has Tg=65° C., Shimadzu flow temperatures $T_1$=113° C. and $T_2$=157° C. The resin was used for the preparation of toner.

EXAMPLE 6

Suspension Copolymerization with Crosslinked Latex Seed

Into a 50 gallon glass lined reactor equipped with an anchor-shaped stirrer, condenser, nitrogen inlet and outlet were added 17.1 lbs of styrene, 3.7 lbs of n-butyl acrylate, 0.9 lb of alpha-methylstyrene dimer, 1.8 lbs of Luperox A75, 55.0 lbs of deionized water and 6.9 lbs of 5% solution of Airvol 540. The content of the reactor was heated under stirring to 30° C. and then 38.5 lbs of emulsion from Example 4 was added during 20 minutes. The heating continued and the reaction mixture was stirred for 6 hrs at 90° C. After cooling to room temperature the suspension was centrifuged, washed and dried in an oven at 60° C. The product has Tg=63° C., Shimadzu flow temperatures $T_1$=119° C. and $T_2$=156° C. The resin was used for the preparation of toner.

EXAMPLE 7

Emulsion-suspension one-pot Copolymerization without Crosslinker

Figure 5:
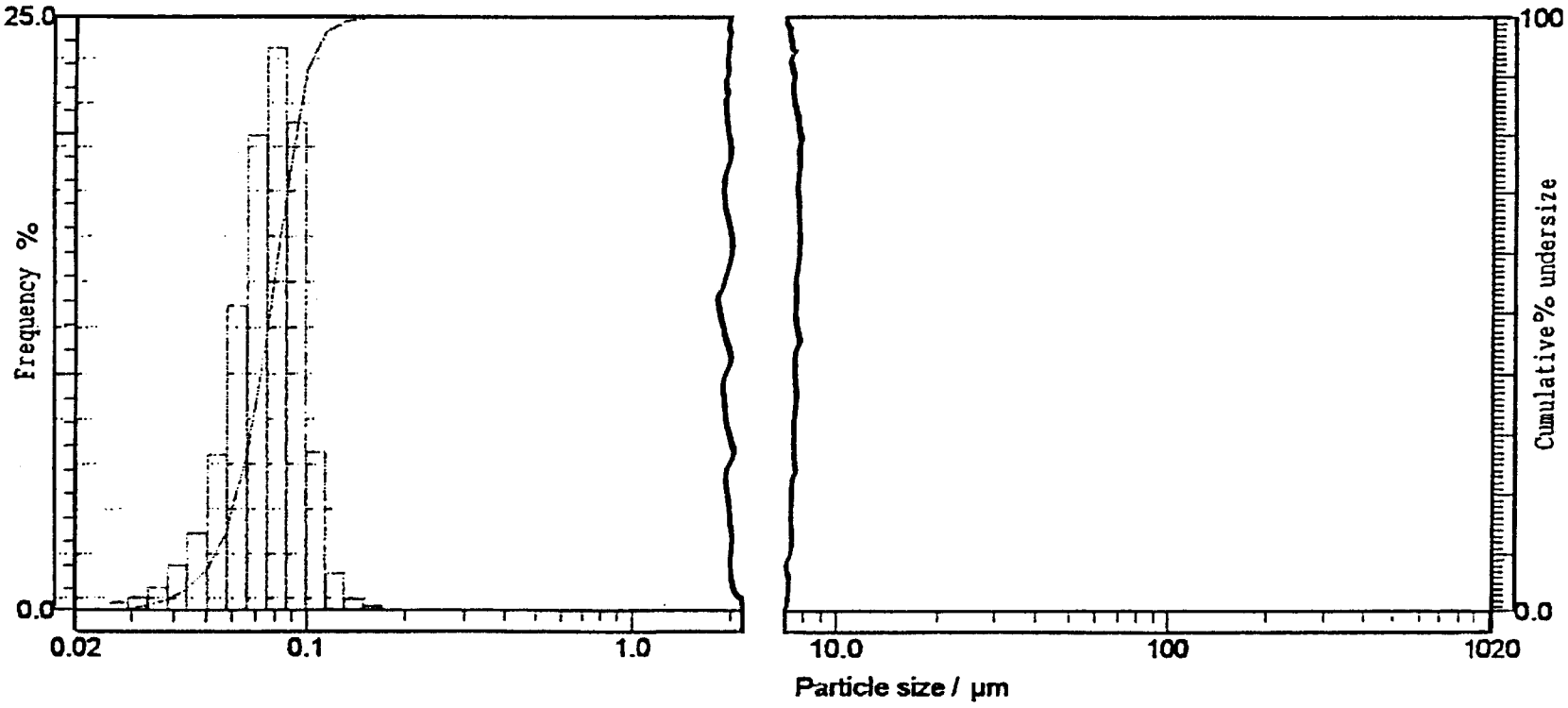
FIG. 5 shows a particle size distribution of styrene-n-butyl acrylate latex used as a seed for subsequent suspension copolymerization in Example 7.

Into a 1000 ml glass reactor equipped with a glass stirrer, condenser, nitrogen inlet and outlet were added 68 g of styrene, 16 g of n-butyl acrylate, 412 g of distilled water, 5 g of Rhodacal LDS-22 and 0.25 g of potassium persulfate. The content of the reactor was heated under nitrogen atmosphere to 70° C. and stirred for 3 hrs. After cooling to 40° C. a small sample was taken for particle size determination (FIG. 5), 78 nm is the median size. After that, 118 g of styrene, 24 g of n-butyl acrylate, 5 g of alpha-methylstyrene dimer, 10 g of Luperox A75, 142 g of distilled water and 25 g of 5% solution of Airvol 540 were added. The content of reactor was heated to 90° C. and stirred for 4 hrs. After cooling to room temperature the suspension was centrifuged, washed and dried in an oven at 60° C. The product has Tg=63° C., Shimadzu flow temperatures $T_1$=104° C. and $T_2$=139° C.

EXAMPLE 8

Emulsion-suspension one-pot Copolymerization without Crosslinker

Into a 50 gallon glass lined reactor equipped with an anchor-shaped stirrer, condenser, nitrogen inlet and outlet were added 16.4 lbs of styrene, 3.9 lbs of n-butyl acrylate, 99.7 lbs of deionized water, 1.18 lbs of Rhodacal LDS-22 and 0.085 lbs of potassium persulfate. The content of the reactor was heated under nitrogen atmosphere to 70° C. and stirred for 3 hrs. Into a prepared emulsion the following components were added: 3.2 lbs of n-butyl acrylate, 0.72 lbs of alpha-methylstyrene dimer, 17.7 lbs of styrene, 1.5 lbs of Luperox A75, 11.6 lbs of deionized water and 4.6 lbs of 5% solution of Airvol 523. The content of the reactor was heated under stirring to 90° C. and then kept at this temperature for 5 hrs. After cooling to room temperature, the suspension was centrifuged, washed and dried in an oven at 60° C. The product had Tg=67° C., Shimadzu flow temperature $T_1$=124° C. and $T_2$=160° C. The resin was used for the preparation of toner.

EXAMPLE 9

Preparation of Toner from a Resin made with an Uncrosslinked Latex

Experimental toner was prepared using bimodal resin from Example 8 using the following general formula: 80–90% resin, 5–15% pigment, 1–7% polypropylene wax and 0.5–2% of a quaternary ammonium compound. The resultant toner was performance tested in a Ricoh 410 machine and the images obtained had good image density, with an absence of fogging and the fusing performance was good with no tendency to hot offset under normal operating conditions.

COMPARATIVE EXAMPLE 1

Preparation of Toner from a Resin made with a Crosslinked Latex

Experimental toner was prepared using bimodal resin from Example 5 using the following general formula: 80–90% resin, 5–15% pigment, 1–7% polypropylene wax and 0.5–2% of a quaternary ammonium compound. Performance was tested in a Ricoh 410 copier. The images obtained had good image density, with an absence of fogging, however there was a tendency to hot offset under certain conditions.

COMPARATIVE EXAMPLE 2

Preparation of Toner from a Resin made with a Crosslinked Latex

Experimental toner was prepared using bimodal resin from Example 6 using the following general formula: 80–90% resin, 5–15% pigment, 1–7% polypropylene wax and 0.5–2% of a quaternary ammonium compound. The performance of toner was tested in a Ricoh 410 copier. The images obtained had good image density, with an absence of fogging, however there was a tendency to hot offset under certain normal operating conditions.

The present invention has been described in detail with reference to the preferred embodiments thereof. However, it will be appreciated that modifications and/or improvements may be made by those skilled in the art without departing from the spirit and scope of the invention as defined by the claims.

What is claimed is:

1. A method for preparing a toner resin having a bimodal distribution of molecular weight, the method comprising the steps of:

forming a first resin portion by emulsion polymerization of at least one monomer; and forming a second resin portion around the first resin portion by suspension polymerization of at least one monomer;

thereby obtaining a resin having a polydispersity in the range of 5 to 50.

2. The method of claim 1, wherein the first resin portion has a particle size in the range of about 50 to about 200 nanometers.

3. The method of claim 1, wherein the same monomers are used to form both the first and the second resin portion.

4. The method according to claim 1, wherein the first resin portion comprises about 20–60% by weight of the toner resin.

5. The method according to claim 1, wherein the first resin portion has a number average molecular weight in the range of about $10^4$ to $10^7$.

6. The method according to claim 1, wherein the second resin portion has a molecular weight in the range of about $2\times10^3$–$8\times10^4$.

7. The method according to claim 1, wherein the ratio of first resin portion to the second resin portion is in the range of about 10/90 to 90/10.

8. The method of claim 1, wherein the emulsion polymerization step utilizes at least one monomer selected from the group consisting of: styrene monomers, acrylate monomers, methacrylate monomers, and derivatives thereof.

9. The method of claim 8 wherein said at least one monomer utilized in the emulsion polymerization step is selected from the group consisting of: styrene, α-methylstyrene, o-methylstyrene, m-methylstyrene, p-methylstyrene, p-methoxystyrene, p-ethylstyrene, 2,3-dimethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-phenylstyrene, p-chlorophenylstyrene, o-chlorostyrene, m-chlorostyrene, p-chlorostyrene, 3,4-dichlorostyrene, acrylic acid, methyl acrylate, ethyl acrylate, n-propyl acrylate, iso-propyl acrylate, n-butyl acrylate, iso-butyl acrylate, amyl acrylate, isoamyl acrylate, n-hexyl acrylate, n-octyl acrylate, 2-ethylhexyl acrylate, lauryl acrylate, n-tridecyl acrylate, n-tetradecyl acrylate, n-hexadecyl acrylate, 2-phenoxyethyl acrylate, 2-chloroethyl acrylate, 2,2,2-trifluoroethyl acrylate, 2-hydroxyethyl acrylate, 2-hydroxypropyl acrylate, dimethylaminoethyl acrylate, diethylaminoethyl acrylate, cyclohexyl acrylate, phenyl acrylate, isobornyl acrylate, stearyl acrylate, acrylonitrile, acrylamide, methacrylic acid, methyl methacrylate, ethyl methacrylate, n-propyl methacrylate, iso-propyl methacrylate, n-butyl methacrylate, iso-butyl methacrylate, amyl methacrylate, isoamyl methacrylate, n-hexyl methacrylate, n-octyl methacrylate, 2-ethylhexyl methacrylate, lauryl methacrylate, n-tridecyl methacrylate, n-tetradecyl methacrylate, n-hexadecyl methacrylate, 2-phenoxyethyl methacrylate, 2-chloroethyl methacrylate, 2,2,2-trifluoroethyl methacrylate, 2-hydroxyethyl methacrylate, 2-hydroxypropyl methacrylate, dimethylaminoethyl methacrylate, diethylaminoethyl methacrylate, cyclohexyl methacrylate, phenyl methacrylate, isobornyl methacrylate, stearyl methacrylate, methacrylonitrile, and methacrylamide.

10. The method of claim 8, wherein the emulsion polymerization step utilizes a styrene-acrylate or a styrene-methacrylate monomer system and provides the first resin portion with a particle size in the range of about 20–500 nm.

11. The method of claim 1, wherein the suspension polymerization step utilizes at least one monomer selected from the group consisting of: styrene monomers, acrylate monomers, methacrylate monomers, and derivatives thereof.

12. The method of claim 11, wherein said at least one monomer utilized in the suspension polymerization step is selected from the group consisting of: styrene, α-methylstyrene, o-methylstyrene, m-methylstyrene, p-methylstyrene, p-methoxystyrene, p-ethylstyrene, 2,3-dimethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-phenylstyrene, p-chlorophenylstyrene, o-chlorostyrene, m-chlorostyrene, p-chlorostyrene, 3,4-dichlorostyrene, acrylic acid, methyl acrylate, ethyl acrylate, n-propyl acrylate, iso-propyl acrylate, n-butyl acrylate, iso-butyl acrylate, amyl acrylate, isoamyl acrylate, n-hexyl acrylate, n-octyl acrylate, 2-ethylhexyl acrylate, lauryl acrylate, n-tridecyl acrylate, n-tetradecyl acrylate, n-hexadecyl acrylate, 2-phenoxyethyl acrylate, 2-chloroethyl acrylate, 2,2,2-trifluoroethyl acrylate, 2-hydroxyethyl acrylate, 2-hydroxypropyl acrylate, dimethylaminoethyl acrylate, diethylaminoethyl acrylate, cyclohexyl acrylate, phenyl acrylate, isobomyl acrylate, stearyl acrylate, acrylonitrile, acrylamide, methacrylic acid, methyl methacrylate, ethyl methacrylate, n-propyl methacrylate, iso-propyl methacrylate, n-butyl methacrylate, iso-butyl methacrylate, amyl methacrylate, isoamyl methacrylate, n-hexyl methacrylate, n-octyl methacrylate, 2-ethylhexyl methacrylate, lauryl methacrylate, n-tridecyl methacrylate, n-tetradecyl methacrylate, n-hexadecyl methacrylate, 2-phenoxyethyl methacrylate, 2-chloroethyl methacrylate, 2,2,2-trifluoroethyl methacrylate, 2-hydroxyethyl methacrylate, 2-hydroxypropyl methacrylate, dimethylaminoethyl methacrylate, diethylaminoethyl methacrylate, cyclohexyl methacrylate, phenyl methacrylate, isobornyl methacrylate, stearyl methacrylate, methacrylonitrile, and methacrylamide.

13. The method of claim 11, wherein the suspension polymerization step utilizes a styrene-acrylate or a styrene-methacrylate monomer system.

14. The method of claim 1, further comprising adding at least one water soluble initiator during the emulsion polymerization step.

15. The method of claim 14, wherein said at least one water soluble initiator is selected from the group consisting of: persulfate salts, hydrogen peroxide or organic hydroperoxides in combination with metal salts, and combinations thereof.

16. The method of claim 14, wherein said at least one water soluble initiator is used in a concentration of about $1.10^{-2}$ to $1.10^{-4}$ mol/L in a water solution.

17. The method of claim 1, further comprising adding at least one stabilizer during the emulsion polymerization step.

18. The method of claim 17, wherein said at least one stabilizer is selected from the group consisting of: anionic emulsifiers, cationic emulsifiers and nonionic emulsifiers.

19. The method of claim 17, wherein said at least one stabilizer is used in amounts of about 1 to 4% by weight based on total amount of monomer.

20. The method of claim 1, further comprising adding a crosslinking agent during emulsion polymerization step.

21. The method of claim 20, wherein said crosslinking agent is selected from the group consisting of: aromatic divinyl compounds, diacrylate compounds, dimethacrylate compounds, oligo and polyethylene glycol diacrylates, oligo and polyethylene glycol dimethacrylates, allyl acrylate, allyl methacrylate, polyfunctional crosslinkers, and combinations thereof.

22. The method of claim 20, wherein said crosslinking agent is used in amounts of about 0.001 to 2 parts by weight per 100 parts of total monomer.

23. The method of claim 1, further comprising adding at least one dispersing agent during suspension polymerization step.

24. The method of claim 23, wherein said at least one dispersing agent is selected from the group consisting of polyacrylic acid, polyvinyl alcohol, cellulose derivatives, inorganic powders and combinations thereof.

25. The method of claim 1, further comprising adding at least one initiator during suspension polymerization step.

26. The method of claim 25, wherein said at least one initiator added during suspension polymerization step is selected from the group consisting of organic peroxides, azo-compounds and combinations thereof.

27. The method of claim 1, further comprising adding a buffering compound during emulsion polymerization step to regulate pH.

28. The method of claim 27, wherein said buffering compound is selected from the group consisting of: sodium hydrogen phosphate, sodium dihydrogen phosphate, sodium bicarbonate, sodium acetate, sodium citrate, or potassium salts thereof.

29. The method of claim 1, wherein the emulsion polymerization step is conducted for about 3 to 6 hours at about 65 to 75° C.

30. The method of claim 1, wherein the suspension polymerization step is conducted for about 4 to 6 hours at about 85 to 95° C.

* * * * *